US005228209A

United States Patent [19]

Brunner

[11] Patent Number: 5,228,209

[45] Date of Patent: Jul. 20, 1993

[54] APPARATUS FOR DRYING OUT WOOD

[76] Inventor: Reinhard Brunner, Vorwerkstrasse 9, 3007 Gehrden, Fed. Rep. of Germany

[21] Appl. No.: 855,323

[22] Filed: Mar. 23, 1992

[30] Foreign Application Priority Data

Mar. 23, 1991 [EP] European Pat. Off. ..... 91 104619.1

[51] Int. Cl.[5] ..... F26B 5/04

[52] U.S. Cl. ..... 34/16.5; 34/73; 34/77

[58] Field of Search ..... 34/16.5, 15, 73, 13, 34/13.4, 13.8, 92, 76–78

[56] References Cited

U.S. PATENT DOCUMENTS

| | | | |
|---|---|---|---|
| 217,273 | 7/1879 | Dowling | 34/16.5 |
| 1,672,326 | 6/1928 | Kobiolke | 34/16.5 |
| 3,283,412 | 11/1966 | Farnsworth | 34/5 |
| 3,574,949 | 4/1971 | Farnsworth | 34/16.5 |
| 3,744,144 | 7/1973 | Weis | 34/16.5 |
| 3,939,573 | 2/1976 | Berti | 34/16.5 |
| 4,893,415 | 1/1990 | Moldrup | 34/16.5 |

FOREIGN PATENT DOCUMENTS

| | | | |
|---|---|---|---|
| 170648 | 2/1986 | European Pat. Off. | 34/16.5 |

*Primary Examiner*—Henry A. Bennett
*Assistant Examiner*—Denise L. Gromada
*Attorney, Agent, or Firm*—Robert E. Burns; Emmanuel J. Lobato

[57] ABSTRACT

Apparatus for drying cut wood has a cylindrical vessel with end covers at least one of which can be opened. The interior of the vessel is divided by a horizontal partition into a drying chamber above the partition, in which the wood is placed, and a condensation chamber below the partition. An opening in the partition provides restricted communication between the chambers. The interior of the vessel is filled with a drying medium made up of air and water vapor. A heater in the drying chamber heats the drying medium and a fan produces circulation of the drying medium in the drying chamber. The upper portion of the vessel wall, above the partition, is heat insulated while the lower portion, below the partition, is uninsulated and serves as a condenser for condensing water vapor in the condensation chamber. The lower portion of the vessel wall is cooled by a blower and by cooling coils in a foundation which supports the vessel. In one embodiment, the wood is stacked on the load platform of a car which runs into the vessel through one end thereof, when open. The load platform of the car serves as the partition between the chambers. The operation of the apparatus is controlled by a microprocessor which has inputs connected with heat, pressure and humidity sensors provided in the vessel.

21 Claims, 3 Drawing Sheets

APPARATUS FOR DRYING OUT WOOD

FIELD OF INVENTION

The present invention relates to apparatus for drying cut wood.

BACKGROUND OF THE INVENTION

Apparatuses for drying cut wood are divided into two types. One type has a condenser arranged outside the vessel containing the cut wood as shown in DE-PS 309 086. The other type has a condenser disposed inside the vessel containing the cut wood which is to be dried. The separation of the condenser from the vessel containing the cut wood to be dried according to the first type has the advantage that the steam atmosphere in the vessel for drying the cut wood is not cooled by the condenser. However apparatus of the first type has the disadvantages of a substantially higher installation cost and requiring more space for the installation. The combining of the condenser in the vessel according to the second type (DE-PS 35 43 248; DE-OS 37 15 515) requires far less space because the condenser is located in the vessel in a chamber where there is no cut wood. That is because, according to DE-PS 35 43 248 and DE-OS 37 15 515 the condenser is located below the carriage which supports the cut wood to be dried and which runs on rails parallel to the axis of the vessel. With the usual horizontal circulation of the drying medium through the pieces of cut wood stacked one above another, a considerable part of the circulating drying medium moves through the condenser and is cooled to such an extent that a part of its moisture content is deposited on the tubes of the condenser. The drying medium cooled in this manner flows, in its circulation, with the circulating drying medium flowing horizontally through the stack of cut wood and is mixed therewith. Thereby, the continually circulating drying medium is wholly cooled and must be again heated in order to be brought to a favorable temperature for drying. The constant mixing of the drying medium cooled in the condenser with the drying medium flowing through the stack of cut wood results in higher energy consumption by reason of the requirement that the drying medium cooled in the condenser must be again heated. Through U.S. Pat. No. 1,625,548 it is known to use the inner side of the cylindrical vessel wall as a condenser. This vessel wall is cooled by water sprayed on its outer surface while the interior of the vessel is heated by an integrated heat register. The moisture of the steam type drying medium is deposited on the inner side of the vessel wall and runs on the inner side of the vessel wall to the bottom of the vessel and is discharged through a valve controlled tube. So that moisture deposited on upper portions of the vessel wall does not fall on the cut wood that is to be dried, there is arranged over the cut wood a roof which leads the dropping moisture to opposite sides of the vessel. This roof takes room which could serve to hold cut wood. Also there is a disadvantage of a constant mixing of the drying medium deposited on the inner side of the vessel wall with the remaining drying medium so that for the reheating of the cooled drying medium additional heat energy is required.

The drying of cut wood by the known apparatus is relatively expensive because high installation costs must be taken into account and also because of a relatively high cost of the energy requirements.

SUMMARY OF THE INVENTION

The present invention avoids the disadvantages of the state of the art. It is the object of the invention to provide, in a simple manner, a cost-favorable means of drying cut wood and, indeed, through the provision of apparatus which is economically constructed and with which energy for again heating the cooled drying medium is not required.

In accordance with the invention, a partition divides the interior of the vessel into two parts, namely a lower portion which constitutes a condensing chamber and an upper portion which constitutes a drying chamber accommodating the cut wood, means for heating the drying medium and means for circulating the drying medium. The two chambers are connected with one another through at least one opening of limited size. Through the partition which divides the vessel into a drying chamber and a condensing chamber, it is achieved that the circulating drying medium in the drying chamber is in effect separated from the drying medium in the condensing chamber. No drying medium from the condensing chamber returns to the drying chamber since the steam-type drying medium is condensed in the condenser and remains as liquid in the condensing chamber from which it is discharged as liquid. At the same time, since partial vacuum prevails in the drying chamber as well as also in the condensation chamber, increased moisture of the moisture from the cut wood enters the drying medium in the form of steam which participates in constant circulation in the drying chamber but always a part is drawn through the opening between the drying chamber and the condensation chamber into the condensation chamber because the condenser effects a volume reducing condensation of the steam in the condensation chamber. With the simple means of a partition having an opening of adjustable size it is achieved that the cooled steam-form drying medium does not reenter the circulating drying medium in the drying chamber. This achieves a considerable economy in energy consumption.

Through regulation of the condenser temperature and through regulation of the effective area of the opening in the partition such an amount of moisture is withdrawn from the moisture latent drying medium in the drying chamber per unit time to equal the amount of moisture which is evaporated from the cut wood and enters the circulating drying medium in the drying chamber in such unit of time. In this manner it is possible to maintain the desired state of the climate prevailing in the drying chamber.

Energy saving is also achieved by providing heat insulating material on the walls of the drying chamber. Preferably the wall of the condensation chamber is not provided with heat insulating material and forms at least part of the condenser.

When the vessel wall forms the condenser, the cost of the apparatus is less because the expense of tubes of a conventional condenser is avoided. At the same time an interruption of operation by reason of required repair of condenser tubes is avoided. Often the outer atmosphere is sufficient as a cooling medium for effecting condensation. That is understandably especially favorable with regard to energy consumption since no energy is required for operation of the condenser. If the climatic conditions are not so favorable for the surrounding atmosphere to provide sufficient cooling for the condenser, the condenser-forming part of the vessel can be provided with cooling channels through which a cooling medium is circulated. Such cooling channels can advantageously be provided in a concrete foundation for the vessel. Preferably the condensation chamber is provided at the bottom of the vessel and the partition forms the top of the condensation chamber.

When it is desired to use a greater portion of the vessel wall as a condenser, the partition is provided at opposite sides with hinged wing portions which extend up inside and are spaced from the vessel wall and are adjustable to vary the spacing of upper edges of the wing portions from the vessel wall and thereby vary the area of the opening with which the condensation chamber communicates with the drying chamber.

It is advantageous when the partition between the drying chamber and the condensation chamber is formed, at least in part, by the load-supporting surface of a carriage for the cut wood that is to dried.

When the partition between the drying chamber and the condensation chamber is provided by the load-carrying platform of a carriage for the wood to be dried, means is provided for effecting a seal between sides of the platform of the carriage and the walls of the vessel. The sealing means can, for example, be inflatable tubes, sealing lips or flaps or the like.

When channels for a cooling fluid are provided in a portion of the wall of the vessel which forms a condenser, means is provided for forcing air or other cooling fluid through such channels.

It is advantageous when there is provided in the drying chamber a heat register through which a heating fluid is passed by suitable supply means.

The operation of the apparatus is preferably controlled by a micro-processor which is programmed so that the unsaturated steam of the drying medium is condensed at a rate which is equal to the rate of evaporation of moisture from the wood being dried.

BRIEF DESCRIPTION OF DRAWINGS

The invention will be more fully understood from the following description of preferred embodiments shown by way of example in the accompanying drawings which.

DESCRIPTION OF PREFERRED EMBODIMENTS

Figure 1:
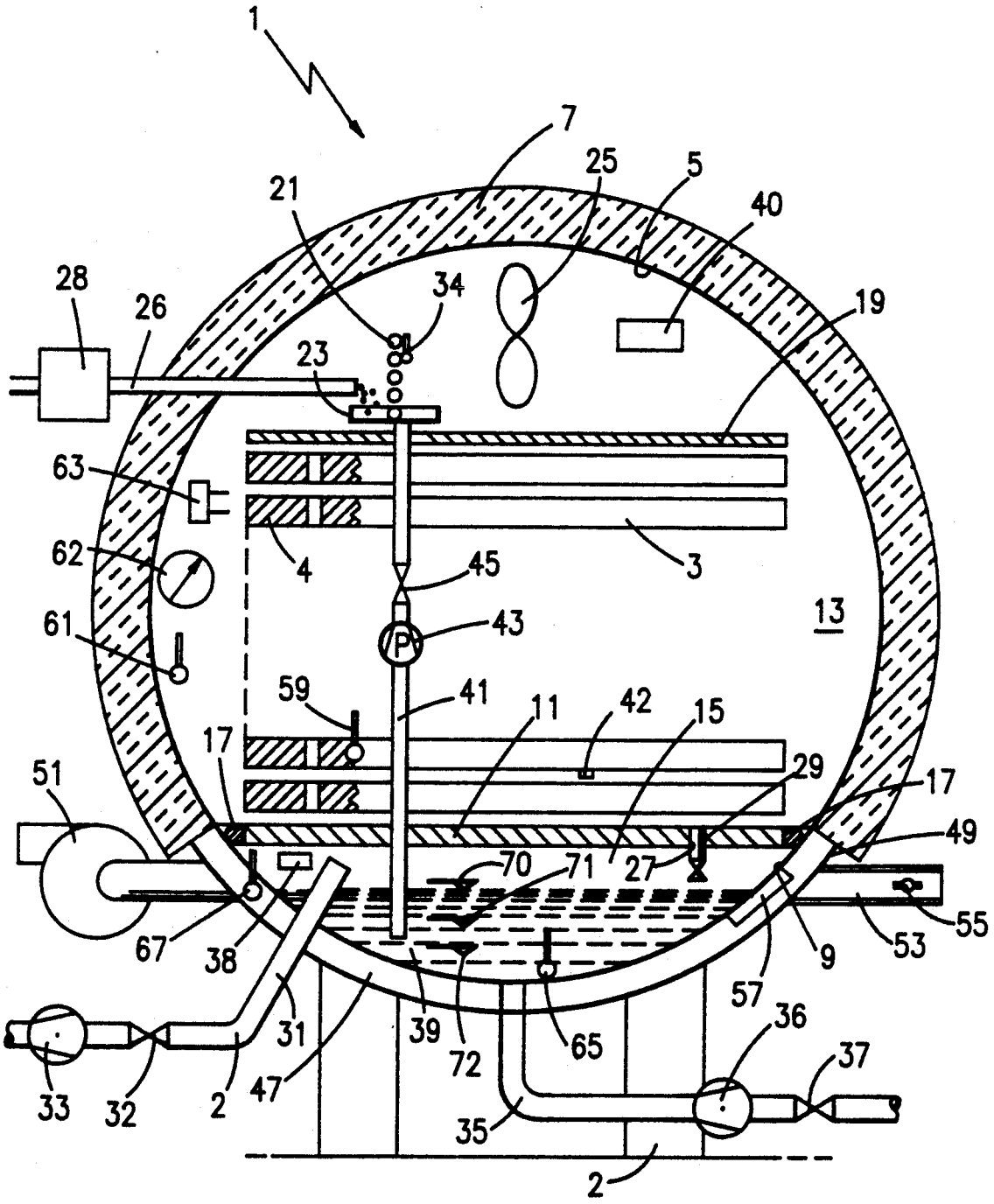
FIG. 1 is a schematic cross-sectional view through drying apparatus in which heat insulating material is provided on the outside of the vessel.

The drying apparatus comprises a long horizontal cylindrical vessel 1 having at both ends round closures or covers (not shown) at least one of which is hinged or removable to provide a charging door for the introduction and removal of a stack of wood 3. The stack of wood 3 consists of pieces of cut wood 4 which, with the help of strips, are spaced apart and staggered with respect to one another to provide for the flow of a drying medium through the stack.

The vessel 1 is supported on a foundation 2 and has over a part of its circumference on the outer side of the vessel wall 5 a layer of heat insulation 7 which, with respect to the axis of the cylinder, extends axially over the entire length of the cylinder. A part 9 of the vessel wall 5 which forms the bottom part of the drying apparatus, is free of the heat insulation 7. At the height of the transition between the portion of the cylinder wall which is covered with heat insulation and the part 9 which is free of heat insulation, there is provided inside the vessel a flat horizontal partition 11 which divides the interior of the vessel into a drying chamber 13 for the cut wood above the partition and a condensation chamber 15 below the partition. On its axially extending side edges, the partition 11 is provided with packing strips 17 which provide a seal between the partition and the inner wall of the vessel. Packing strips (not shown) are also provided between the ends of the partition 11 and the end covers of the cylinder. The upper surface of the partition 11 forms a bearing area for supporting the stack of cut wood 3 in the drying chamber 13.

In the drying chamber 13 above the stack of cut wood 3 there is arranged a flat horizontal false floor 19. As seen in FIG. 1, the false floor 19 covers the stack of cut wood 3 but does not extend to the sides of the cylindrical vessel. In the drying chamber above the false floor 19 there is a heat register 21 with a plurality of axially extending heating coils arranged in a vertical row with the lower most heating coil lying in a trough 23. The energy consumption of this lower most coil in the trough 23 is controllable independently of the energy consumption of the remaining heating coils. Through a pipe 26 controlled by a valve 28 water can be delivered to the trough 23 where it is evaporated to produce water vapor to adjust the climate in the drying chamber. Moreover in the drying chamber 13 above the false floor 19 there are ventilators 25 for circulating the drying medium in the drying chamber 13 which is formed of unsaturated steam (hot steam) or a steam-air mixture. The ventilators, which are shown schematically as fans 25, produce in the entire drying chamber a circulating stream of a drying medium which flows through the stack of wood 3. The speed of rotation of the fans 25 is controlled by the temperature in the vessel 1.

The horizontal partition 11 has an opening 27 through which the drying chamber 13 is connected with the condensation chamber 15. The cross-sectional area of the opening 27 is variable by means of a valve arrangement 29 which is controllable from outside the vessel. A suction pipe 31 extends from outside the vessel into the condensation chamber 15 with its inner end opening a short distance below the partition 11. The suction pipe 13 is connected through a valve 32 with a vacuum pump 33.

At the lower most portion of the floor of the condensation chamber 15 there is a discharge pipe 35 which is connected with a pump 36 and a discharge valve 37. Through the outlet pipe 35, pump 36 and outlet valve 37, condensate which has collected in the condensation chamber can be discharged.

From this bottom region of the condensation chamber, which forms a receptacle for the collected condensate 39, a riser tube 41, which has its lower end in the collected condensate 39, extends up to the trough 23 of the heat register 21. In the riser tube 41 there are a pump 43 and a valve arrangement 45 which are controllable from outside the drying chamber.

The part 9 of the vessel wall 5 which is free of heat insulation 7 and which surrounds the condensation chamber 15, forms the inner wall of a cool air channel 47 of which the outer wall is formed by a mantle 49 of metal or plastic that is spaced a relatively short distance from the part 9 of the vessel wall 5 and extends parallel thereto. Blowers 51 are connected with the cool air channel 47 in order to produce a cooling air stream in the air channel 47. The blowers 51 are exhaust blowers which exhaust air from the air channel 47 and thereby draw atmospheric air in through a cool air inlet 53, the cross-section of which is controllable by means of a throttle 55, and discharges it back to the atmosphere. The speed of rotation of the blowers is controlled by the temperature in the condensation chamber 15.

In order to increase the heated exchanging efficiency of the part 9 of the vessel wall 5 which serves as a condenser and thereby increase the capacity of the condenser, various measure can be used as desired. For example cooling ribs 57 can be provided on the part 9 of the vessel wall 5 in the cool air channel 47. Ribs can also be provided on the inner side of the part 9 of the vessel wall 5. Instead of cool air, another cooling medium, for example, cool water, can be caused to flow through the channel 47.

In the drying chamber 13, in condensation chamber 15 as well as in the cool air channel 47, suitable instruments are provided for monitoring temperature, pressure and other climate values.

Of these instruments, there are shown by way of example in FIG. 1 a temperature sensor 59 for determining the core temperature of the stack of wood 3 as well as, in the drying chamber 13, a temperature sensor 61, a pressure sensor 52 and a sensor 53 for measuring the relative humidity. A temperature sensor 65 on the bottom of the container for the collected condensate 39 measures the temperature of the condensate.

Moreover in the air channel 47 there is provided a temperature sensor 67 for determining the cool air temperature. Moreover in the condensation chamber 15 there are provided level sensors 70, 71 and 72 for determining the maximum, median and minimum levels of condensate collected in the bottom part of the vessel. Moreover there is at least one sensor for measuring the average and wood core dampness.

Figure 2:
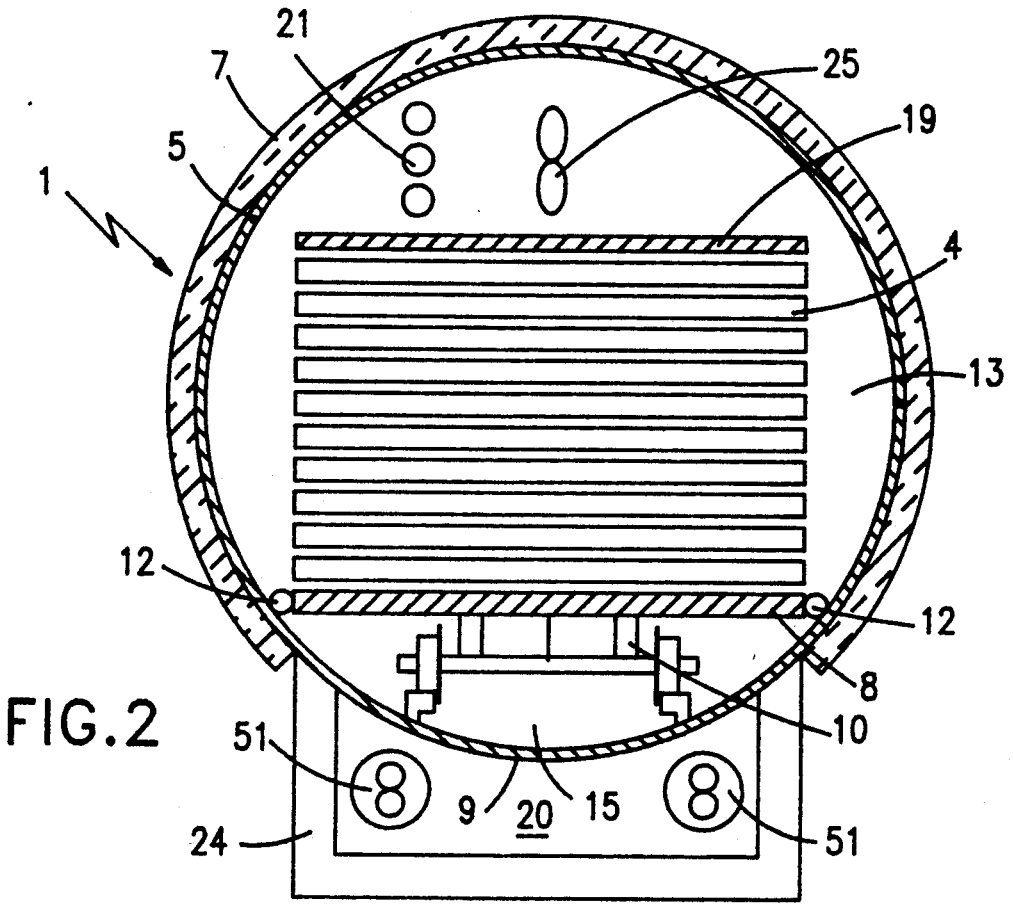
FIG. 2 is a schematic cross-sectional view of apparatus having channels for a cooling medium provided in the base of the vessel.

In the embodiment shown in FIG. 2 the wood to be dried is stacked on a car or carriage 10 which runs on rails R for movement of the stack of wood into and out of the vessel. The load-carrying surface 8 of the carriage 10 forms a partition between the drying chamber and the condensation chamber of the vessel. Elongate sealing members 12 are provided between the edges of the platform 8 and the wall of the vessel. These are, for example, air filled, inflatable tubes.

It will be understood that the strength of the load carrying surface must be sufficient to withstand the forces resulting from pressure difference which, in operation, prevail between the drying chamber 13 and the condensation chamber 15 so as to permit great pressure differences.

By means of the vacuum pump 33, valve 32 and suction pipe 31, a desired partial vacuum can be produced in the condensation chamber 15 and, by reason of the presence of the through-opening 27, also in the drying chamber 13, whereby the pressure relation between the two chambers is adjustable through the corresponding control of the valve arrangement 29 and the opening 27. When the drying is effected by pure water vapor (hot steam) i.e. after evacuation of all of the air by means of the suction pump 33, the partial vacuum can be regulated solely through the temperature of the condenser. Through control of the heat output of the heat register 21, the drying medium which is circulated in the drying chamber 13 by means of the ventilators 25 can be brought to a desired temperature in order to heat the stack of wood 3 and to carry out the desired dehydration. On the basis of the measured values of the temperature sensor 59 for the core temperature of the wood and the sensors 61, 62 and 63 for climate data in the drying chamber 13, the desired drying climate in the drying chamber 13 can be adjusted in dependence on the selected pressure relationship. The moisture extraction out of the drying medium entering the condensation chamber is primarily influenced by the temperature of the condenser. By reason of the separation between the drying chamber 13 and condensation chamber 15 the result of the procedure can be thereby influenced that by adjustment of the opening size of the through opening 27 through control of the valve arrangement 29, the entry and the diffusion of air and steam can be controlled according to the desired rate of dehydration of the stack of wood 3. The condenser capacity and its temperature is controllable through the cool air flow in the air channel 47. In operation of the apparatus in an area with not exceedingly high ambient temperature no additional air cooling of the heat insulation 7 free part 9 of the vessel wall 5 is required. With cooling through the outer air, the outer mantle 45 of the cool air channel 47 would be unnecessary.

The collected separated fluid 39 is drawn off through the discharge pipe 35 by means of the pump 36 and the valve 37 according to the level of fluid measured by the sensors 70, 71 and 72.

In cases in which an addition of steam to the drying chamber 13 is necessary for climate control of the chamber, condensate from the condensation chamber 15 can be delivered through the riser tube 41 by means of the pump 43 and valve 45 to the trough 23 where it is evaporated by the heat of the heat register 21. The pump 43 has provision for reverse operation. Under certain circumstances the heat register 21 can be switched off and used as a cooling register and thereby serve as an additional condenser in the drying chamber 13 whereby the condensed fluid is collected in the trough 23 and through the valve 45 and the reversed pump 43 is delivered to the condensation chamber 15.

For reasons of cost, the vessel 1 can be produced from steel concrete. The condensate collected in the container can serve as a stabilizer against temperature variations in the condensation chamber 15. The collected water can also be circulated in order to increase the heat transfer between the water and the part 9 of the vessel wall 5.

Through the partition 11, which can also serve as a load platform, there is thus effected a separation of the drying chamber 13 and the condensation chamber 15 whereby it is guaranteed that with continual drying, the condenser in the condensation chamber 15, which can also be a conventional condenser, is not disturbed by the circulating drying medium. Hereby energy loss through air and/or steam flowing through the condenser and thereby being cooled by the condenser to condense its moisture content is avoided since the drying medium does not return from the condensation chamber to the drying chamber.

In the embodiment shown in FIG. 2 the stack of wood 4 rests on the load surface 8 of a car or carriage 10 which runs on rails R, parallel to the axis of the vessel, for movement into and out of the vessel. The load surface 8 forms the partition between the drying chamber 13 and the condensation chamber 15. In order for the load surface 8, serving as the partition 11, to be sufficiently sealed, there are arranged on the edges of the load surface 8 inflatable tubes 12 which serve the function of a packing. On the ground of simplification, many details of the vessel, which are shown in FIG. 1, are not shown in FIG. 3 and FIG. 4.

The vessel 1 rests on a foundation 24 which is suitably formed of concrete. This foundation is of U-shape in cross-section. The inner space between the inner wall of the foundation 24 and the uninsulated part 9 of the vessel wall forms a cooling channel 20 in which cool air is circulated by a blower or ventilator 51 in the channel 20.

Figure 3:
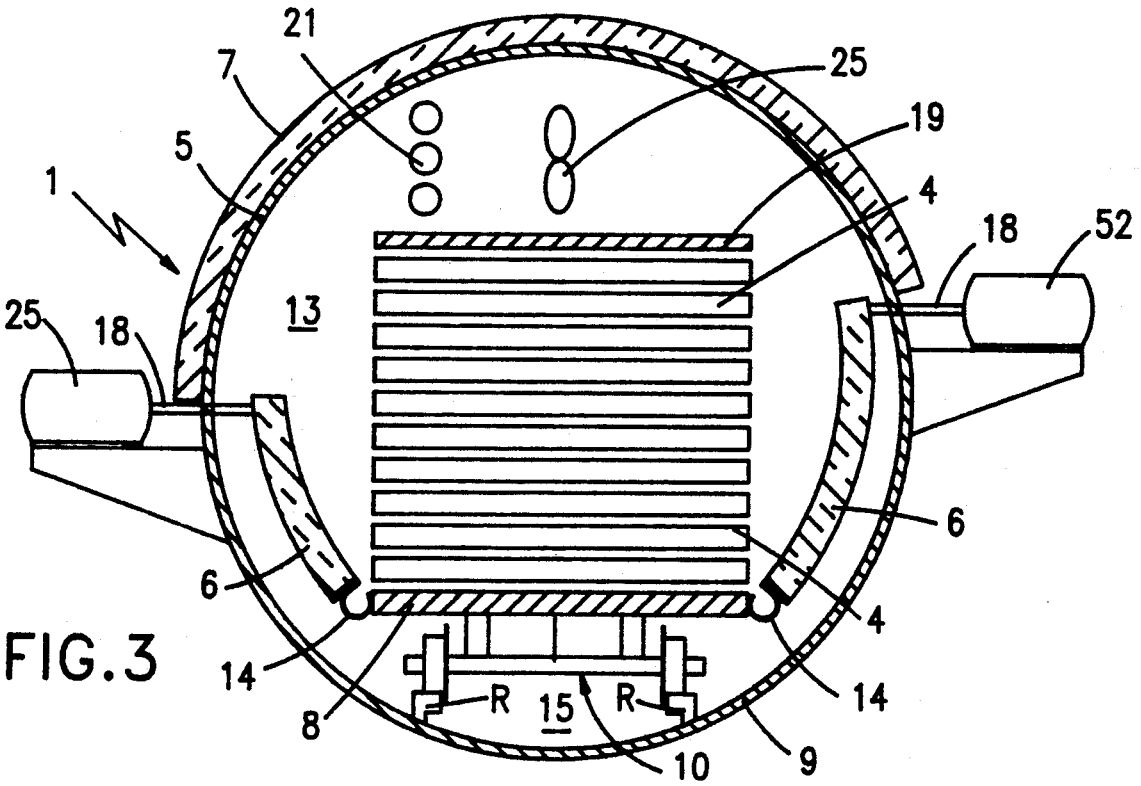
FIG. 3 is a schematic cross-sectional view of apparatus with enlarged condenser surfaces.

The embodiment shown in FIG. 3 likewise has a car or carriage of which the load surface 8 of the carriage 10 forms the partition between the drying chamber 13 and the condensation chamber 15. On the side edges of the load surface 8 there are provided lip seals 14 which press against insulating walls 6. These insulating walls 6 form extensions of the partition on its two opposite sides which serve to increase the condensation surface of the condensation chamber 15. These insulating walls 7 narrow the drying chamber 13 relative to the embodiments of FIGS. 1 and 2 but the drying chamber remains insulated on all sides. The insulation 7 on the outer side of the vessel is smaller as the insulating walls 6 now limit the drying chamber 13. Through slides 18 driven by electric motors 52, the passage for the steam from the drying chamber 13 into the condensation chamber 15 can be decreased or increased in cross-section and can be completely closed.

The insulated wall portions 6 can be fixed or swingable on the edges of the load surface 8 of the carriage 10. In this case packings are provided on the upper ends on the insulating wall portions 6.

Figure 4:
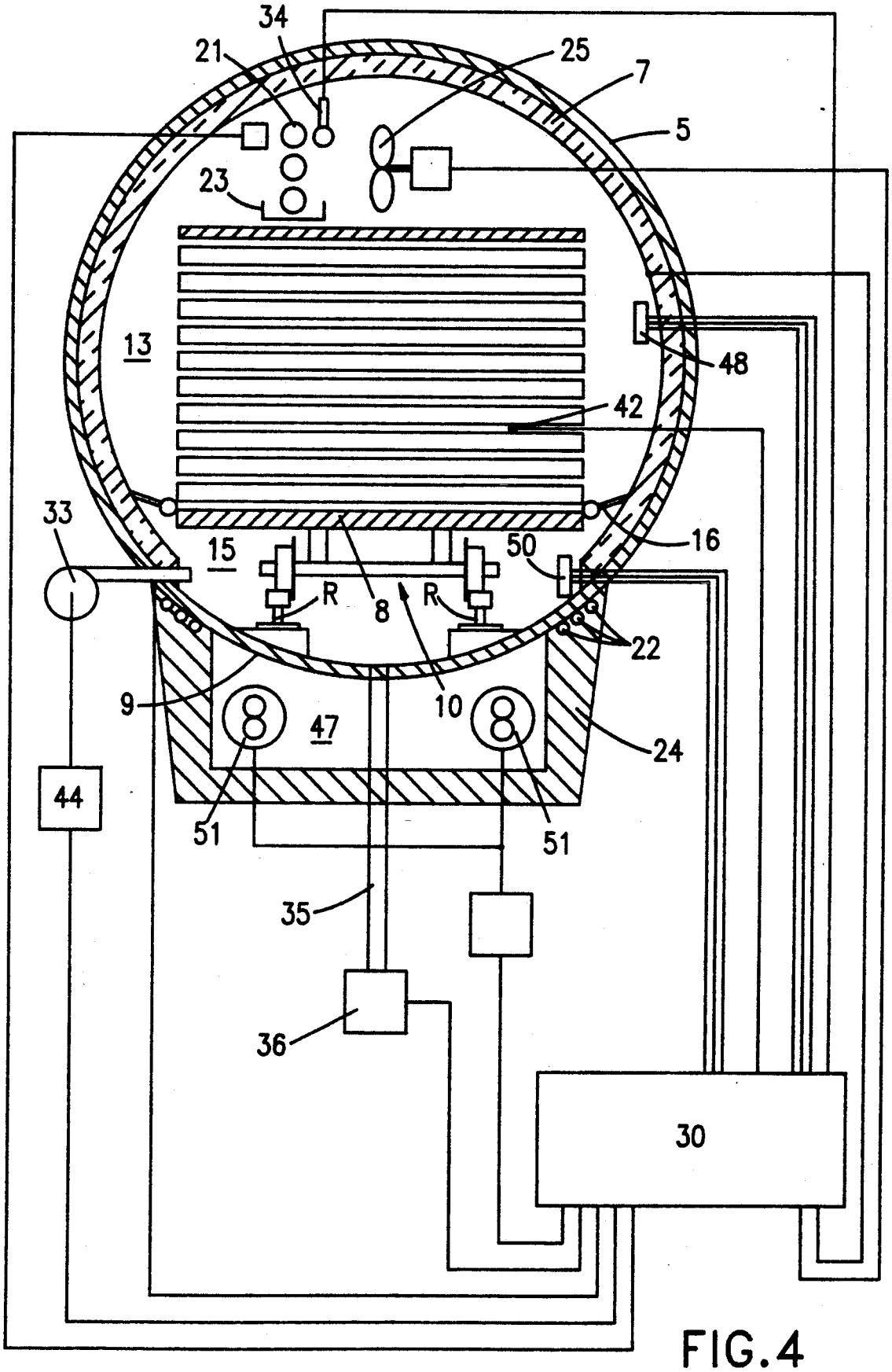
FIG. 4 is a schematic cross-sectional view and of drying apparatus with heat insulation on the inner surface of the vessel and also showing control circuitry of the apparatus.

In the embodiment shown in FIG. 4, the heat insulation 7 of the drying chamber 13 is arranged on the inside of the vessel 1. There is not heat insulation on the inside of the lower part 9 of the vessel. This has the advantage that more surface of the vessel wall 5, 9 is in contact with the outer atmosphere, but has a disadvantage that the drying chamber is smaller by the volume of the heat insulation 7.

In FIG. 4 the load surface 8 of a car or carriage 10 likewise forms the partition between the drying chamber 13 and the condensation chamber 15. A seal between the load surface 8 and the vessel wall is here formed by flexible flaps 16.

In all of the embodiments, the inner chamber of the vessel 1 is partially evacuated by a vacuum pump 46 whereby a device 44, which is actuated by the control device 30, puts the vacuum pump 33 into operation as required.

In the embodiment of FIG. 4, the vessel 1 likewise rests on a concrete foundation 24 of which the inner wall surfaces form a cooling channel 47. Additionally there are provided, in the foundation, cooling tubes 22 of a cooling device for cooling the outer side of the uninsulated portion 9 of the vessel wall. The different sensors needed for controlling the process are housed together in an instrument case 49 in the drying chamber and in an instrument case 50 in the condensation chamber.

The operation of the apparatus is controlled by a control unit 30 comprising a microprocessor having inputs connected to the temperature sensors 34, 59, 61, 65 and 67 in the drying chamber 13, preferably in the stream of drying medium and/or in the condensation chamber 15 and/or in and/or on the stack of cut wood 3 and/or in the condensate 39 and/or in and/or on the heat register 21 and/or in and/or on the cooling channels 47 and also to pressure sensor 62 in the drying chamber 13 and/or the condensation chamber 15 and/or humidity sensors 38, 40, 42 in the cut wood 4 and/or in the cut wood stack 3 and/or in the drying chamber 13 and/or in the condensation chamber 15 and/or a sensor of relative humidity 63 and/or liquid level sensors 70, 71 and 72 in the condensation chamber 15 and/or a pressure sensor 62 for sensing the pressure prevailing in the vessel 1. Outputs of the microprocessor are connected with a device 21 for adjusting the heat input to the drying chamber 13 and/or a device 51 for adjusting the cooling of the condenser-forming part 9 of the wall of the vessel 1 and/or a control device for controlling the speed of the ventilators 25, 51 for cooling the condensers 9 and/or the recirculated drying medium in the drying chamber 13 and/or a device 44 for vacuum pump 33 and/or a device 29 for adjusting the cross sectional area of the opening between the drying chamber 13 and the condensation chamber 15 and/or a device 36 for controlling the height of the condensate in the condensation chamber 15 and/or the trough 23 under the heat register 21.

What I claim is:

1. Apparatus for drying cut wood comprising a cylindrical vessel having end covers, at least one of which can be opened, a partition dividing the interior of said vessel into an upper portion constituting a drying chamber and a lower portion constituting a condensation chamber, the wood to be dried being placed in said drying chamber, said drying chamber and condensation chamber being filled with a drying medium comprising air and water vapor, means for providing restricted communication between said drying chamber and said condensation chamber, means for heating said drying medium in said drying chamber, circulating means for producing circulation of said drying medium in said drying chamber including circulation of said drying medium around said wood, means for condensing water vapor of said drying medium in said condensation chamber, and means for withdrawing air from said condensation chamber.

2. Apparatus according to claim 1, further comprising means for sensing the temperature in said drying chamber and for controlling the speed of operation of said circulating means in accordance with said temperature.

3. Apparatus according to claim 1, in which said means for providing restricted communication between said drying chamber and said condensation chamber comprises an opening in said partition and means for varying the cross-sectional area of said opening.

4. Apparatus according to claim 1, in which an upper portion of a cylindrical wall of said vessel above said partition is insulated with heat insulating material and in which a lower portion of said cylindrical wall of said vessel is free of heat insulation material and constitutes a condenser for condensing water vapor in said condensation chamber.

5. Apparatus according to claim 4, further comprising means for cooling said uninsulated lower portion of said cylindrical wall of said vessel.

6. Apparatus according to claim 5, in which said means for cooling a lower portion of cylindrical wall of said vessel comprises a jacket spaced outwardly from said lower portion of said cylindrical wall of said vessel and fluid circulating means for circulating a fluid through the space between said jacket and said lower portion of said cylindrical wall of said vessel.

7. Apparatus according to claim 6, further comprising means for sensing the temperature in said condensing chamber and for controlling the operation of said fluid circulating means in accordance with said temperature.

8. Apparatus according to claim 1, further comprising a foundation for supporting said vessel and for providing means for cooling said lower portion of said cylindrical wall of said vessel.

9. Apparatus according to claim 8, in which said foundation is of a cross-sectional shape to define a channel for cooling fluid for cooling said lower portion of said cylindrical wall of said vessel.

10. Apparatus according to claim 8, in which tubes for cooling fluid are provided in said foundation.

11. Apparatus according to claim 1, in which said means for heating said drying medium comprises a heat register in said drying chamber.

12. Apparatus according to claim 11, in which said heat register is disposed partially in a horizontal trough and in which means is provided for supplying water to said trough.

13. Apparatus according to claim 12, in which said means for supplying water to said trough comprises controllable means for transferring condensate from said condensation chamber to said trough.

14. Apparatus according to claim 12, in which said means for supplying water to said trough comprises a water supply pipe extending in to said trough from outside said vessel and a valve controlling flow of water through said water supply pipe to said trough.

15. Apparatus according to claim 1, in which said means for producing circulation of drying medium in said drying chamber comprises a circulator in said drying chamber.

16. Apparatus according to claim 1, further comprising a carriage having a load platform for supporting wood to be dried, said carriage being movable into said vessel through one end thereof when open, said load platform constituting at least part of said partition when said carriage is in said vessel.

17. Apparatus according to claim 16 further comprising sealing means for providing a seal between edges of said load platform and the wall of said vessel when said carriage is in said vessel.

18. Apparatus according to claim 17 in which said sealing means comprises an inflatable tube.

19. Apparatus according to claim 17, in which said sealing means comprises flaps on edges of said load platform.

20. Apparatus according to claim 16, further comprising wing portions of insulating material provided on side edges of said platform of said carriage, said wings extending upwardly from said platform and being spaced inwardly from the wall of said vessel, portions of said walls of said vessel overlying said wing portions being free of heat insulation.

21. Apparatus according to claim 1, further comprising means for removing condensate from said condensation chamber.

* * * * *